US006935346B2

(12) United States Patent
Bushby et al.

(10) Patent No.: US 6,935,346 B2
(45) Date of Patent: Aug. 30, 2005

(54) SMOKING ARTICLE COMPRISING A WRAPPER CONTAINING A CERAMIC MATERIAL

(76) Inventors: Alison Bushby, 7 Roseberry Close, Hatch Warren, Basingstoke (GB), RG22 4XR; Kevin Gerard McAdam, 70 Methuen Street, Inner Avenue, Southampton (GB), SO16 6FR; Nicholas Leslie Timms, 68 Cowley Close, Maybush, Southampton (GB), RSO16 WE ( * ) Notice: Subject to any disclaimer, the term of this patent is extended or adjusted under 35 U.S.C. 154(b) by 0 days.

(21) Appl. No.: 10/148,977

(22) PCT Filed: Nov. 29, 2000

(86) PCT No.: PCT/GB00/04522

§ 371 (c)(1),
(2), (4) Date: Jun. 5, 2002

(87) PCT Pub. No.: WO01/41590

PCT Pub. Date: Jun. 14, 2001

(65) Prior Publication Data

US 2002/0189625 A1 Dec. 19, 2002

(30) Foreign Application Priority Data

Dec. 7, 1999 (GB) ..... 9928853

(51) Int. Cl.[7] ..... A24D 3/14

(52) U.S. Cl. ..... 131/334; 131/365; 131/349; 162/139

(58) Field of Search ..... 131/334, 365, 131/349; 162/139

(56) References Cited

U.S. PATENT DOCUMENTS

| | | | | |
|---|---|---|---|---|
| 1,581,619 | A | | 4/1926 | Sulzberger |
| 2,020,646 | A | | 11/1935 | Hornstein |
| 2,098,619 | A | | 11/1937 | Finnell |
| 2,307,088 | A | | 1/1943 | Whiteley |
| 2,733,720 | A | | 2/1956 | Schur |
| 2,998,012 | A | | 8/1961 | Lamm |
| 3,030,963 | A | | 4/1962 | Cohn |
| 3,220,418 | A | | 11/1965 | Cohn |
| 3,744,496 | A | | 7/1973 | McCarty et al. |
| 4,061,147 | A | | 12/1977 | Falchi |
| 4,108,151 | A | | 8/1978 | Martin et al. |
| 4,146,040 | A | | 3/1979 | Cohn |
| 4,187,862 | A | | 2/1980 | Cohn |
| 4,225,636 | A | | 9/1980 | Cline et al. |
| 4,433,697 | A | | 2/1984 | Cline et al. |
| 4,480,650 | A | | 11/1984 | Weinert |
| 4,505,282 | A | | 3/1985 | Cogbill et al. |
| 4,638,819 | A | | 1/1987 | Ikeda |
| 4,915,117 | A | | 4/1990 | Ito |
| 4,938,238 | A | | 7/1990 | Barnes et al. |
| 5,060,674 | A | * | 10/1991 | Brown et al. ..... 131/365 |
| 5,105,837 | A | | 4/1992 | Barnes et al. |
| 5,105,838 | A | | 4/1992 | White et al. |
| 5,159,944 | A | | 11/1992 | Arzonico et al. |
| 6,810,884 | B2 | | 11/2004 | Snaidr et al. |
| 2002/0062834 | A1 | * | 5/2002 | Snaidr et al. ..... 131/365 |

FOREIGN PATENT DOCUMENTS

| | | |
|---|---|---|
| EP | 0 251 254 A1 | 1/1988 |
| EP | 0 467 405 A2 | 1/1992 |
| EP | 0 380 324 B1 | 1/1995 |
| EP | 1 084 629 A1 | 3/2001 |
| WO | WO 98/16125 | 4/1998 |
| WO | WO 99/53778 | 10/1999 |

* cited by examiner

*Primary Examiner*—Dionne A. Walls
(74) *Attorney, Agent, or Firm*—Steven A. Witters; Charles I. Sherman; Middleton Reutlinger

(57) ABSTRACT

The invention describes a smoking article (1) comprising a wrapper (3) enwrapping a tobacco smoking material (2), the wrapper comprising a ceramic material and being capable of mechanically trapping mainly aqueous particulate phase materials in the sidestream smoke, thereby reducing sidestream smoke deliveries considerably despite the use of the wrapper with conventional tobacco materials.

43 Claims, 1 Drawing Sheet

SMOKING ARTICLE COMPRISING A WRAPPER CONTAINING A CERAMIC MATERIAL

This Application is a 371 of PCT/GB00/04522, filed on Nov. 11, 2000.

This invention relates to smoking articles and in particular, but not exclusively, to cigarettes.

Numerous attempts have been made over the years to provide a smoking article that has reduced sidestream smoke yields. Many of these attempts have suggested the utilisation of non-tobacco smoking materials, such as smoking materials incorporating inorganic filler materials which are non-combustible and in themselves produce a low amount of combustion products. Our recent International Patent Application, Publication No. WO 96/07336 disclosed a smoking article having a high proportion of non-combustible, inorganic material and comprising a substantially non-combustible wrapper extending along the full length of the smoking material rod and enwrapping a fuel source and aerosol generating means. However, this application specifically relates to non-tobacco or substantially non-tobacco containing smoking materials, hence its high inorganic material content. The wrapper of this disclosure has proved to be somewhat ineffective in sustaining smoulder under normal smoking conditions when wrapping a tobacco smoking material. Standard machine smoking conditions are a 35 ml puff of 2 second duration per minute.

International Patent Application, Publication No. WO 98/16125 describes re-usable ceramic tubular materials that require mechanical addition of porosity by the provision of slits covered with a porous material. These tubular materials do not burn down and usually require an annular air passageway between the tubular material and tobacco insert to allow combustion. One embodiment comprises a fibrous ceramic woven cloth having a natural permeability, in contact with a tobacco insert. The woven cloth is not combustible and a porous woven material is required in order to allow air ingress to the tobacco insert and, hence, combustion of the tobacco insert within the tubular material. This woven cloth does not burn down. Another embodiment describes a tubular sheet of fibrous material that is mildly calcined to remove binder material thereby creating porosity. Again, this variation in the ceramic tubular material does not combust or burn down after the calcining stage and is re-usable.

Even more recently, International Patent Application, Publication No. WO 99/53778 described a cigarette sidestream smoke treatment material made from a sheet of non-combustible active components treated during its manufacture to provide a porous structure capable of affecting sidestream smoke. The treatment material comprises a hydrophobic sorbent material having significant porosity and large micropore size, i.e. a material having a high surface area capable of sorbing particulate material. The sheet material preferably contains an oxygen releasing compound that enhances the oxidation treatment of the adsorbed components. The smoking material within the sheet material is cut tobacco. This article works by sorbing non-aqueous vapour phase smoke material and combusting that material more thoroughly in an enhanced oxygen environment. There is also selective chemical filtration of the sidestream smoke. The sidestream smoke treatment material of this document does not burn down as smoking proceeds, so the article does not have a conventional appearance during smoking.

Both of these described prior art documents are not designed to provide a wrapper that closely imitates conventional ashing properties of a cigarette.

U.S. patent application No. 4,915,117 describes a cigarette having a thin sheet for holding tobacco. In one embodiment the sheet is formed by coating or impregnating a paper with inorganic adhesive and drying the resultant sheet to form a paper having a ceramic layer. The prior art document describes a wrapper requiring a paper material to provide support for the ceramic layer formed thereon.

This invention has as an object the provision of a smoking article containing a conventional smoking material and an unconventional wrapper comprising a proprtion of non-combustible material, the wrapper burning with a visible burn line that progresses along the length of the smoking article during smoking.

The invention has a further object the provision of a smoking article having substantially normal ashing characteristics, the ash being removable by normal smoking techniques, i.e. flicking off by the consumer or stubbing-out of the smoking article.

The invention also has as another object to provide a wrapper that does not require ageing by heat treatment in order to produce a porous structure. The wrapper of the present invention may be dried to remove moisture but is not heated to >280° C. Heating above 150° C. is undesirable as the wrapper will discolour. Such a wrapper may be known as a "green ceramic wrapper". As used herein "green ceramic wrapper" means a wrapper not heated to more than 100° C. at any stage during the making thereof.

The invention also has as a further object the provision of a wrapper that does not require mechanical treatment to provide the necessary porosity required in order for the wrapper to combust.

The present invention provides a smoking article comprising a wrapper material enwrapping a tobacco smoking material, the wrapper containing a proportion of a ceramic filler of predefined shape, a binder, optionally a burn additive and optionally an ash improver.

The predefined shape of the ceramic filler is a shape that when mixed with a binder in a wrapper the wrapper has a porous self-sustaining structure and when combusted during smoking the wrapper loses its structural integrity. The wrapper is advantageously a green ceramic wrapper.

Preferably the ceramic material is a particulate material.

Preferably the predefined shape of the ceramic filler is spherical or substantially spherical, oval or substantially oval, or another irregular shape approximating thereto.

Advantageously the ceramic filler has a particle size in the range of 2–90 $\mu$m, more preferably 2–75 $\mu$m and even more preferably 25–70 $\mu$m. Preferably the mean particle size is greater than 30 $\mu$m, more preferably greater than 35 $\mu$m and even more preferably greater than 40 $\mu$m. A mean particle size of about 50 $\mu$m appears to be highly advantageous. The preferred particle size may be achieved by milling a suitable ceramic filler having a larger particle size down to within the advantageous range and/or the preferred size.

Preferably the ceramic filler has a regular or irregular, non-platelet particle shape. Advantageously, the ceramic filler is an insoluble or low solubility metal oxide or metal salt. The ceramic filler is preferably a thermally stable metal oxide or metal salt. The ceramic filler may be one or more of alumina, silica, an alumino-silicate, silicon carbide, stabilised or un-stabilised zirconium oxide, zircon, garnet, feldspar, or other materials known to the skilled man and having the necessary particle size or other suitable ceramic materials having been milled to the necessary size or shape.

Preferably the ceramic filler is present at greater than 40% by weight of the dry materials in the slurry producing the wrapper, and is more preferably present in the range of 50–95%, more preferably 70–90%, and even more preferably 70–87.5%.

Advantageously the ceramic filler is not an activated filler, and hence have a low surface area, although activated ceramic fillers do work in the present invention.

Preferably the binder is an organic binder selected from one or more of an alginate, such as calcium alginate, propylene glycol alginate, a gum, a cellulose (modified or natural), a pectin or pectinaceous binder, starch, or the Group I or II metal salts of these binders, such as sodium carboxymethylcelulose or sodium alginate.

In addition or alternatively, the binder may advantageously be an inorganic binder capable of cementing the particles of ceramic filler together. The inorganic binder is preferably an activated inorganic material. The inorganic binder may be one or more of activated alumina, aluminium silicate, magnesium silicate or an inert clay.

Preferably the inorganic binder has a particle size in the range of 2–90 $\mu$m, more preferably in the range of 2–50 $\mu$m and is even more preferably in the range of 2–15 $\mu$m. The inorganic binder is suitably hydrophobic.

Preferably the binder is present at greater than 2% by weight of the dry materials in the slurry producing the wrapper, and is preferably present in the range of 3–30%, is more preferably <20% and even more preferably <10% by weight of the dry materials in the slurry. Most preferably the binder is in the range of 3–10%. The amount of ceramic filler and binder selected will depend on the binding properties of the binder selected.

The burn additive is usually present in the wrapper at a weight which is greater than that seen on paper wrappers. Preferably the burn additive is present in the range of 1–15% by weight of the dry materials in the slurry used to produce the wrapper and is more preferably <10% and even more preferably <5%. The burn additive is most preferably in the range of 2–5%. Preferably the burn additive is a burn promoter. Suitable burn additives may be selected from one or more of salts of Group I or II metals such as acetates, citrates and other burn promoters known to the skilled man.

The burn additive is selected to give the best burn characteristics and the most acceptable ash colour upon smoking. The burn additive may be a residue of the setting agent(s) selected and described below.

The ash improver is present to provide bridging means or packing improvement means between the ceramic filler particles. The invention has as an aim the provision of a wrapper that does burn down and can ash like a conventional smoking article. The components of the wrapper, and in particular the ceramic filler and ash improver, have a particle size and/or shape such that their combination provides the necessary strength in the wrapper before combustion but loses such strength during combustion in order to provide acceptable ashing of the combusted products.

The inorganic ash improver suitably has a platelet morphology and is blended with the ceramic filler in order to control the permeability, ashing strength, colour and burning properties. The ash improver is optional but is advantageously present in the wrapper in the range of 0–5%. Materials that have the appropriate platelet morphology compared to the more rounded shape of the ceramic filler, include one or more of mica, chalk, perlite, clays, such as, for example, vermiculite; kaolinites and talcs. These materials might also be suitable as the ceramic filler provided they can be milled to the appropriate size and shape.

Alternatively the ash improver may be a material with a very small particle size such that particles thereof bridge the voids between the larger ceramic filler particles.

In a further alternative the ash improver is advantageously a material that increases the pH of the slurry forming the wrapper. Suitable materials capable of increasing the pH of the slurry from 8 to about 10 include Group I or II metal salts of carbonate and hydroxide.

The wrapper advantageously is permeable and preferably has a permeability less than 200 Coresta Units (CU) and is preferably in the range of 2–100 CU. More preferably the permeability of the wrapper is in the range of 5–50 CU and may be less than 10 CU.

The wrapper should have a density of 0.5–3.0 g/cm$^3$, preferably 0.8–1.2 g/cm$^3$ and more preferably of the order of about 1.0 g/cm$^3$ and should have a tensile strength capable of withstanding manual handling. The wrapper advantageously is capable of sustaining a thickness in the range of 0.2–0.6 mm.

Advantageously the wrapper is formed as a tube in the manner described in our earlier application WO 96/07336.

The wrapper may be formed by producing a thick slurry of the wrapper components, coating the slurry about a rotating mandrel, and removing excess moisture by physical or chemical means. Alternatively, the slurry may be cast as a sheet on a drum or band caster, or extruded as a hollow tube, through a "torpedo" die-head, for example, which has a solid central section, or extruded as a sheet material. The slurry could be sprayed, coated or pumped onto a suitably shaped fuel/aerosol assembly.

The extrusion process is suitably carried out at a pressure which does not detrimentally affect the wrapper permeability and is suitably not greater than 3–4 bar (300–400 kPa) at the extruder die of a ram extruder, for example, and not more than 9 bar (900 kPa) for an APV Baker Perkins screw extruder. The extrusion process may require foaming to occur at the die exit to produce a cellular structure, in which case greater pressure can be exerted, at the die, whilst retaining permeability.

After extrusion or coating the hollow extrudate or coated mandrel is suitably subjected to heat at or exit the die to drive off excess moisture. The wrapper slurry may comprise a heat activated binder, such as potassium silicate, magnesium oxide, or hydroxypropylcellulose at temperatures above 40–50° C., for example. Subjecting the coated mandrel or hollow extrudate to heat would activate the binder causing the wrapper to set. Infra-red or microwave heating is advantageous as direct heating, e.g. the use of hot air blowers, can affect the shape of the extrudate, especially at temperatures of greater than 100° C.

Extrusion may be carried out using a single or double screw extruder, a ram extruder or slurry pump.

The wrapper suitably has a thickness within the range of 0.1–1.0 mm, although 2–3 mm may be desirable. The thickness required depends on the weight and permeability of the wrapper. Thus, a dense thin wrapper or a thick low density wrapper could be provided, depending on the composition of the wrapper materials.

Alternative setting methods for the wrapper include the use of water scavenging substances. These substances remove water from the wrapper slurry thereby, in effect, drying the wrapper. For example, light magnesium oxide can be in the wrapper slurry mixture at up to 45% by weight of the dry slurry constituents, depending on the residence time in the extruder and the temperature in the extruder. The addition of magnesium oxide can also have advantageous visible sidestream reducing effects. Alternatively, the wrapper material can be extruded into an ethanol bath, or other strongly hydrophilic substance, the ethanol scavenging the water from the extrudate. A further alternative is the precipitation of an insoluble alginate from a soluble alginate in the extruded wrapper. This can be achieved by, for example, extruding a hollow tube of, for example, sodium alginate-containing wrapper material into a bath of simple electrolyte (s), for example, 1.0 M calcium chloride solution. The calcium ions substitute for the sodium ions and cause the extrudate to set extremely quickly. In the latter two methods, spraying of the water scavenger onto the extrudate or wrapper sheet may be carried out instead of passing the extrudate into a bath.

Divalent or trivalent ion solutions have been used; a preferred combination has been the use of sodium alginate in the extruded tube and a calcium ion solution in the bath. The most commonly used salt for setting alginates, for example, is the calcium chloride salt. However, this salt retards the burn rate of the tube wrapper and the acetate salt in this invention is much preferred.

Some precipitation can be achieved by adding a sub-critical level of a precipitating agent into the extruder barrel, then completely precipitating the structure by raising the level of the precipitating agent post extrusion. Other precipitation methods include precipitation of the extrudate into a highly ionic electrolyte bath or into a water miscible non-solvent for the alginate.

A further method includes, as briefly mentioned above with respect to the binders, use of a conventionally insoluble alginate as the binding material by rendering it soluble with a solubilising agent and then setting of the wrapper structure by removal of the solubilising agent or addition of a sequestering agent.

These methods may be used sequentially, e.g. the wrapper may be set by precipitating a soluble alginate containing wrapper material in a bath containing calcium ions. The extrudate may be subsequently passed into a bath of water scavenging agent, such as ethanol, and then heated to drive off liquid residues. Alternatively, after setting the wrapper may be dried using the methods described above.

These methods are particularly effective for achieving a good shape to the extrudate because of the speed of the reaction and the lack of volume reduction in the processes, particularly the drying stages.

The wrapper may have a rigid structure, although we have found that flexible wrappers can be produced using sodium alginate as the binder, which is then precipitated to form calcium alginate and then slowly dried. Flexibility is advantageous in terms of the increased robustness of the product during machine and manual handling.

The setting time of the wrapper when formed as an extruded tube is critical and will depend on the cation and anion combination, the strength of the solution into which the tube is extruded and the residence time of the tube in the ion bath.

Sidestream reducing compounds, such as magnesium oxide, may also be incorporated into the wrapper in order to enhance the sidestream reduction.

The smoking material of the invention may suitably be cut tobacco and may be a conventional blend of cut lamina and stem with or without an expanded tobacco portion. Faster burning tobaccos, such as Maryland or modified Virginia, may be preferred tobaccos for use in the instant invention in order to maintain an acceptable smoulder rate, although unmodified Virginia and US blended tobacco blends have each individually been successful in the instant invention.

Preferably the smoking article comprises at least 50% cut lamina tobacco, more preferably 60% and even more preferably 70%.

Alternatively, the burn rate of the smoking article is brought to the required range by adjusting the loading level of the burn additive in conjunction with the other wrapper characteristics and smoking material composition or blend.

The smoking material may suitably include a proportion of tobacco, non-tobacco, mixtures thereof or any of the above to which aerosol generating material has been added. These materials may be such as reconstituted tobacco or alternative smoking materials, including any of the alternative smoking materials described in WO 96/07336, and in particular the carbon-containing fuel sources described at pages 15–18 thereof, the aerosol generating means of pages 19–22 thereof and the aerosol generating fuel sources of pages 22–24 thereof; WO 97/32491, particularly the filler material described at pages 2–6 thereof; WO 97/32492, particularly the material described at pages 2–4 thereof; WO 97/32490, particularly the material described at pages 2–6 thereof; and WO 98/57556 (a smoking material comprising a non-polyol aerosol generator, up to 20% by weight tobacco, binder at not more than 20% by weight and not less than 30% inorganic filler) and each being further incorporated in their entirety herein by reference. The proportion of reconstituted or alternative smoking material may be from 10–100% by weight of the smoking material.

The smoking material is preferably wrapped in an inner wrapper, such as a porous plugwrap material or a porous cigarette paper. The inner wrapper maintains intimate contact of the burning coal with the outer wrapper. The smoking material rod therefore has a diameter slightly smaller than the inner diameter of the wrapper of the smoking article. The inner wrapper may incorporate an amount of particulate carbon to enhance burning. Alternatively, other burn enhancers may be incorporated.

The inner wrapper preferably has a permeability of greater than 6,000CU and more preferably of greater than 12,000CU. The porosity of the inner wrapper is somewhat determined by the need to be able to glue the inner wrapper without glue seeping through the wrapper.

The smoking articles of this invention may advantageously be used in combination with conventional fibrous cellulose acetate filters. Dual or triple filters incorporating carbon may also be used.

The invention will now be described, by way of example, with reference to the diagrammatic drawings hereof, in which.

Figure 1:
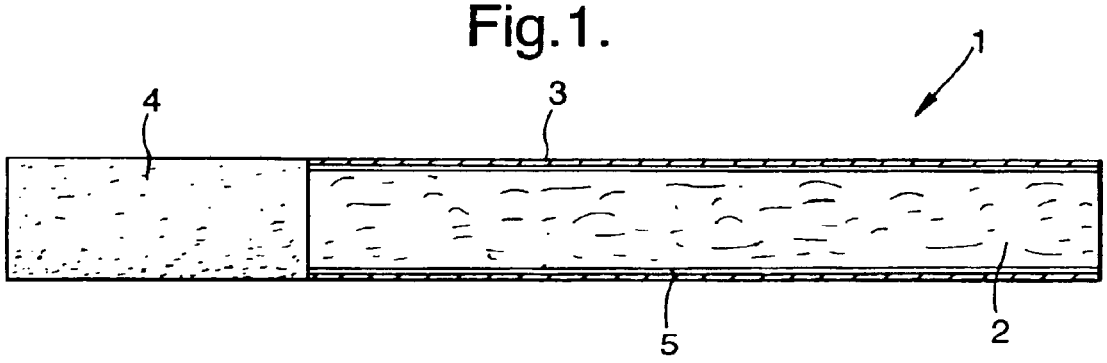
FIG. 1 shows a smoking article according to the invention.

A smoking article 1 comprises a tobacco rod 2 wrapped in a wrapper 3 and attached to a fibrous cellulose acetate filter 4.

A smoking article wrapper 3 was prepared by producing a viscous paste comprising 10% sodium alginate (organic binder), 82.5% alumina (ceramic filler) having a mean particle size of 45 $\mu$m, 2.5% calcium carbonate (inorganic ash improver) and 5% tri-potassium citrate (burn additive) in a mix totalling 100 g and then mixed with 60 ml water. The paste was extruded using a ram extruder through a 7.5 mm external diameter torpedo die into a 0.75M calcium acetate solution. The extruded tube was left in the solution for a period of 10–60 seconds, removed, cut to length and then air-dried in a conditioning room at 60% RH and 22° C. on a support of suitable size. The tube had a circumference of about 23.5 mm and a wall thickness of about 0.5 mm. The moisture content of the dried rod is about 2%.

A tobacco rod 2 containing a blend of Virginia tobacco was meanwhile machine wrapped in a porous plugwrap of 12,000CU to produce a wrapped tobacco rod having an external diameter which ensures intimate contact of the rod with the internal walls of the outer extruded wrapper.

The following examples were prepared using two different tobacco blends wrapped in a conventional paper wrapper of 80 CU as controls. The same blends were used in a smoking material rod wrapped in an inner wrapper with the unconventional outer wrapper described above. All smoking articles were 57 mm in length with 27 mm fibrous cellulose acetate filter rods.

EXAMPLE 1

Control and prototype cigarettes were produced as described above. The tobacco weight and tobacco rod circumferences are given in Table 1.

TABLE 1

| Cigarette Code | Tobacco weight burnt (mg) | Circumference of tobacco rod (mm) |
|---|---|---|
| USB Control | 585 | 24.5 |
| USB Prototype | 344 | 19 |
| Virginia Control | 585 | 24.5 |
| Virginia Prototype | 344 | 19 |

Mainstream smoke yields for these cigarettes are given in Table 2 below.

TABLE 2

| Mainstream smoke yields (mg/cig) | USB Control | USB Prototype | Virginia control | Virginia Prototype |
|---|---|---|---|---|
| TPM | 15.85 | 19.17 | 15.49 | 17.49 |
| NFDPM | 12.12 | 12.6 | 12.53 | 11.12 |
| NHFDPM | 10.5 | 10.83 | 11.88 | 10.35 |
| Water | 2.5 | 5.5 | 1.74 | 5.48 |
| Nicotine | 1.23 | 1.07 | 1.22 | 0.95 |
| Glycerol | 1.14 | 1.01 | 0 | 0 |
| Triacetin | 0.48 | 0.76 | 0.65 | 0.77 |
| Puff No. | 6.4 | 5.7 | 6.9 | 5.6 |

TPM = Total particulate matter
NFDPM = Nicotine free dry particulate matter
NHFDPM = Nicotine humectant free dry particulate matter Sidestream smoke yields for each cigarette are given in Table 3 below. Table 4 also gives the percentage change in sidestream smoke between the control cigarettes and the prototypes. A minus number indicates a percentage reduction compared with the control.

TABLE 3

| Sidestream smoke yields (mg/cig) | USB Control | USB Prototype | Virginia Control | Virginia Prototype |
|---|---|---|---|---|
| TPM | | 3.44 | | 2.59 |
| NFDPM | 25.1 | 2.6 | 25.6 | 2.2 |
| Nicotine | | 1.48 | 5.21 | 1.18 |
| CO | 46.6 | 28.9 | 51.2 | 25.5 |
| $CO_2$ | 362 | 275 | 404 | 218 |

TABLE 4

| Sidestream smoke component | % change between USB control and prototype | % change between Virginia control and prototype |
|---|---|---|
| NFDPM | −89.6 | −90.9 |
| CO | −38 | −50.2 |
| $CO_2$ | −24 | −46 |
| Nicotine | | −77.4 |

The results show that there is a surprising decrease in the yields of sidestream smoke components compared with a conventionally wrapped product. There can be obtained a 90% decrease in NFDPM. There is a more efficient use of tobacco and although less tobacco is burnt the mainstream tar deliveries are consistent with a full flavour product. There are thus product design opportunities for using much less tobacco in lower delivery or full flavour products.

EXAMPLE 2

A further formulation for the wrapper was also produced prepared in the same manner and comprising 7% sodium alginate and 3% hydroxypropyl cellulose, (organic binders), 20% activated alumina (inorganic binder), 63.5% calcined alumina (ceramic filler) having a mean particle size of 50 $\mu$m, 1–5% calcium carbonate (inorganic ash improver) and 5% potassium acetate (burn additive).

A tobacco rod containing the same blend of Virginia tobacco and porous plugwrap as previously was produced using this wrapper.

The mainstream and sidestream smoke data are given in Table 5 below, compared with the Virginia tobacco blend control cigarette (as used above).

TABLE 5

| Smoke Components | Virginia Prototype II Mainstream Smoke Yields (mg/cig) | Sidestream Smoke Yields (mg/cig) | |
|---|---|---|---|
| TPM | 15.71 | 2.19 | |
| NFDPM | 8.94 | 2.01 | (−92.1) |
| NHFDPM | 8.91 | | |
| Water | 5.71 | | |
| Nicotine | 1.02 | 0.38 | (−92.7) |
| Glycerol | 0.00 | | |
| Triacetin | 0.02 | | |
| Puff No. | 7.20 | | |
| CO | | 40.11 | (−21.6) |
| $CO_2$ | | 397.64 | |

The figures in brackets are the percentage reductions in sidestream smoke yields compared with the Virginia control in Table 3.

Figure 2:
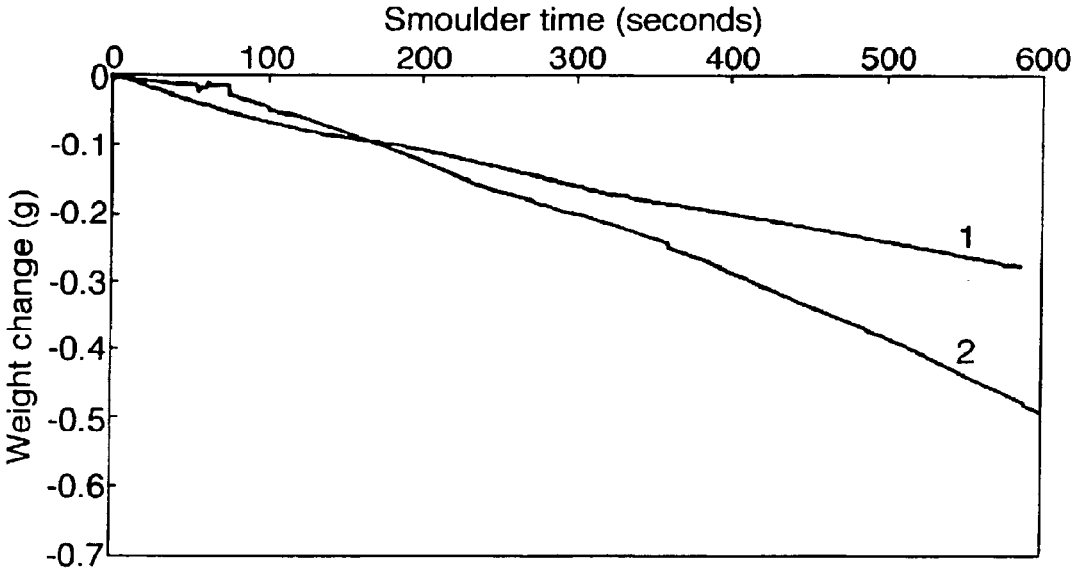
FIG. 2 shows the free smoulder time of the Virginia control (Line 2) and the prototype (Line 1).

FIG. 2 shows the free smoulder time of smoking articles according to the invention. The free smoulder time is similar to a conventional product, being about 10 minutes. The smoulder rate of the inventive product is lower that that of the control. The consumption rate of tobacco is similar for both the prototype in Example 1 and the Virginia control.

The smoking articles produced had an ash that could be readily removed under normal smoking conditions and was of an acceptable colour.

The mechanism of sidestream reduction with the instant invention is by mechanical trapping of the sidestream smoke particles. Mainly the aqueous particulate phase of the sidestream smoke is trapped.

A surprising advantage of the instant invention is that the sidestream smoke levels achieved are at least of a comparable order to the sidestream smoke levels of a non-tobacco containing smoking material wrapped in the wrapper hereof, despite the tobacco content of the smoking material. Significant filtering of sidestream smoke components is therefore achieved.

What is claimed is:

1. A smoking article comprising a wrapper material enwrapping a smoking material comprising at least 50% tobacco, said wrapper comprising a binder, a material selected from the group consisting of a burn additive, ash improver, and combinations thereof, said wrapper further having particles of ceramic filler selected from the group consisting of non-activated alumina, silica, alumina-silicate, silicon carbide, stabilized zirconium oxide, un-stabilized zirconium oxide, zircon, garnet, feldspar, and combinations thereof, said particles of ceramic filler having a predefined shape and being present in a range of about 50–95% by weight of dry materials in a slurry producing said wrapper.

2. A smoking article according to claim 1, wherein said wrapper is a green ceramic wrapper.

3. A smoking article according to claim 1, wherein said predefined shape of said particles of ceramic filler is spherical, substantially spherical, oval, substantially oval, or another irregular shape approximating thereto.

4. A smoking article according to claim 1, wherein said particles of ceramic filler have a mean particle size in a range of about 2–90 $\mu$m.

5. A smoking article according to claim 4, wherein said particles of ceramic filler have a mean particle size in a range of about 2–75 $\mu$m.

6. A smoking article according to claim 5, wherein said particles of ceramic filler have a mean particle size in a range of about 25–70 $\mu$m.

7. A smoking article according to claim 6, wherein said mean particle size of said particles of ceramic filler is greater than 30 $\mu$m.

8. A smoking article according to claim 7, wherein said mean particle size of said particles of ceramic filler is greater than 35 $\mu$m.

9. A smoking article according to claim 8, wherein said mean particle size of particles of ceramic filler is about 50 $\mu$m.

10. A smoking article according to claim 1, wherein said particles of ceramic filler have a non-platelet particle shape.

11. A smoking article according to claim 1, wherein said particles of ceramic filler are an insoluble or low solubility metal oxide or metal salt.

12. A smoking article according to claim 1, wherein said particles of ceramic filler are present in a range of about 70–90%.

13. A smoking article according to claim 1, wherein said particles of ceramic filler are present in a range of about 70–87.5%.

14. A smoking article according to claim 1, wherein said particles of ceramic filler arc not an activated filler.

15. A smoking article according to claim 1, wherein said binder is an organic binder.

16. A smoking article according to claim 15, wherein said organic binder is one or more of an alginate, a gum, a modified cellulose, a natural cellulose, a pectin or pectinaceous binder, starch, or the Group I or II metal salts of these binders.

17. A smoking article according to claim 1, wherein said binder is an inorganic binder.

18. A smoking article according to claim 17, wherein said organic binder is an activated inorganic material.

19. A mucking article according to claim 1, wherein said binder is present in a range of about 2–30% by weight or dry materials in said slurry.

20. A smoking article according to claim 19, wherein said binder is present in a range of about 3–10%.

21. A smoking article according to claim 1, wherein said wrapper has a permeability of <200 Coresta Units (C.U.).

22. A smoking article according to claim 21, wherein said wrapper has a permeability in a range of about 5–50 C.U.

23. A smoking article according to claim 1, wherein said wrapper has a density in a range of about 0.5–3.0 g/cm$^3$.

24. A smoking article according to claim 1, wherein said smoking material is cut tobacco comprising cut lamina and stem.

25. A smoking article according to claim 1, wherein said smoking material comprises one or more of reconstituted tobacco material, non-tobacco material or alternative smoking materials.

26. A smoking article according to claim 1 wherein said wrapper has a burn additive.

27. A smoking article according to claim 1 wherein said wrapper has an ash improver.

28. A smoking article comprising a wrapper material circumscribing a smoking material, said wrapper having particles of ceramic filler of predefined shape, a binder, a bum additive in a range of about 1–15% by weight of dry materials in a slurry used to produce said wrapper and an ash improver in a range of less than 5% by weight of said wrapper, said particles of ceramic filler being selected from the group consisting of non-activated alumina, silica, alumino-silicate, silicon carbide, stabilized zirconium oxide, un stabilized zirconium oxide, zircon, garnet, feldspar, and combinations thereof and being resent in a range of about 50–95% by weight of dry materials in said slurry producing said wrapper.

29. A smoking article according to claim 28 wherein said particles of ceramic filler have a mean particle size in a range of about 25–70 $\mu$m.

30. A smoking article according to claim 28 wherein said mean particle size of said particles of ceramic filler is about 50 $\mu$m.

31. A smoking article according to claim 28 wherein said binder is one or more of an alginate, a gum, a modified cellulose, a natural cellulose, a pectin or pectinaceous binder, starch, or the Group I or II metal salts of these binders.

32. A smoking article according to claim 31, wherein said binder is present in a range of about 3–10%.

33. A smoking article according to claim 28 wherein said burn additive is selected from one or more of salts of Group I or II metals.

34. A smoking article according to claim 28 wherein said wrapper has a permeability in a range of about 5–50 C.U.

35. A smoking article according to claim 28 wherein said wrapper has a density in a range of about 0.5–3.0 g/cm$^3$.

36. A smoking article comprising a wrapper material enwrapping a tobacco smoking material, said smoking material has at least 50% tobacco, said wrapper has a material selected from the group consisting of a burn additive, as improver, and combinations thereof, said wrapper further has a binder and particles of ceramic filler, said particles of ceramic filler being present in a range of about 50–95% by weight of dry materials in a slurry producing said wrapper.

37. A smoking article according to claim 36, wherein said burn additive is present in a range of about 1–15% by weight of dry materials in said slurry used to produce said wrapper.

38. A smoking article according to claim 37, wherein said burn additive is present in a range of about 2–5%.

39. A smoking article according to claim 38, wherein said burn additive is selected from one or more of salts of Group I or II metals.

40. A smoking article according to claim 38, wherein said burn additive is a burn promoter.

41. A smoking article comprising a wrapper material circumscribing a tobacco smoking material, said smoking material having at least 50% tobacco, said wrapper having particles of ceramic filler of predefined shape, a binder, a burn additive in a range of about 1–15% by weight of dry materials in a slurry used to produce said wrapper and an ash improver in a range of less than about 5% by weight of said wrapper, said particle of ceramic filler being present in a range of about 50–95% by weight of dry materials is in said slurry producing said wrapper.

42. A smoking article according to claim 41, wherein said ash improver is present in said wrapper in a range of up to 5% by weight of dry materials in said slurry used to produce said wrapper.

43. A smoking article according to claim 42, wherein said ash improver is one or more of mica, chalk, perlite, or clays.

* * * * *